US006335085B1

(12) United States Patent
Asano et al.

(10) Patent No.: US 6,335,085 B1
(45) **Date of Patent: *Jan. 1, 2002**

(54) INK JET RECORDING SHEET

(75) Inventors: Shinichi Asano, Ichikawa; Takaaki Kouro, Chiba; Shunichiro Mukoyoshi, Ichikawa, all of (JP)

(73) Assignee: Oji Paper Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/890,989

(22) Filed: Jul. 10, 1997

(30) Foreign Application Priority Data

Jul. 12, 1996 (JP) ..... 8-182932

(51) Int. Cl.[7] ..... B41M 5/00

(52) U.S. Cl. ..... 428/195; 428/328; 428/331

(58) Field of Search ..... 428/331, 195, 428/328

(56) References Cited

U.S. PATENT DOCUMENTS

| | | | | | |
|---|---|---|---|---|---|
| 5,275,846 | A | * | 1/1994 | Imai et al. | |
| 5,576,088 | A | * | 11/1996 | Ogawa et al. | 428/327 |
| 5,670,242 | A | * | 9/1997 | Asano et al. | 428/212 |

FOREIGN PATENT DOCUMENTS

| | | | |
|---|---|---|---|
| EP | 0 495 591 A1 | | 7/1992 |
| EP | 0 634 283 A1 | | 1/1995 |
| EP | 0 685 344 A2 | | 12/1995 |
| JP | A-7-89220 | * | 4/1995 |
| JP | A-7-329412 | * | 12/1995 |

* cited by examiner

*Primary Examiner*—Pamela R. Schwartz
(74) *Attorney, Agent, or Firm*—Armstrong, Westerman, Hattori, McLeland & Naughton, LLP

(57) ABSTRACT

An ink jet recording sheet having excellent gloss and ink absorption and capable of recording clear ink images with a high color density includes a substrate sheet impregnated or coated with a cationic compound; an ink-receiving layer formed on the cationic compound-applied substrate sheet and containing a pigment and a binder and a gloss layer formed on the ink receiving layer and containing a polymer resin produced from ethylenically unsaturated monomers.

6 Claims, No Drawings

INK JET RECORDING SHEET

BACKGROUND OF THE INVENTION

1. Field of the Invention

The present invention relates to an ink jet recording sheet. More particularly, the present invention relates to an ink jet recording sheet which has excellent ink jet recording properties and has excellent gloss of the ink image-formed portions and the non-image-formed portions thereof.

2. Description of the Related Art

The recording by an ink jet printer is often utilized in many fields because printing noise is low, the recording can be affected at a high speed and full-colored images can be easily formed. As recording sheets for the ink jet printing system, wood-free paper sheets modified so as to enhance the ink absorption thereof, and coated paper sheets having a coating surface layer containing porous pigment particles are used. These conventional recording paper sheets mostly have a low surface gloss and a matted appearance. Currently, new types of ink jet recording sheets having a high surface gloss and good appearance are in demand.

Generally, as printing paper sheets having a high surface gloss, coated paper sheets having a high gloss and produced by coating a surface of a paper sheet substrate with a coating layer containing plate-crystalline pigment particles and optionally applying a calendering treatment to the coating layer and cast-coated paper sheet produced by coating a surface of a paper sheet substrate with a coating liquid, pressing the coating liquid layer against a mirror-finished surface of a heating drum and drying the coating liquid layer on the mirror-finished surface of the heating drum so as to transfer the mirror surface to the resultant coating layer, are used.

The cast-coated paper sheets are mostly used for high gloss printing, because they have higher surface gloss and surface smoothness than those of the usual calender-finished coated paper sheets, and thus render excellent printing effect. However, when the cast-coated paper sheets are used for the ink jet recording system, various difficulties occur.

A conventional cast-coated paper sheet is disclosed in U.S. Pat. No. 5,275,846. In this cast-coated paper sheet, a high gloss is obtained by transferring the mirror-finished drum surface of a cast-coater to a coating layer containing a pigment and a film-forming binder. This film-forming binder causes the resultant coating layer to be non-porous and thus to exhibit a significantly reduced ink absorption when the cast-coated paper sheet is used for the ink jet recording system. To enhance the ink absorption, it is necessary to make the coating layer porous, so that the resultant porous coating layer can easily absorb the ink. To enhance the porosity of the coating layer, it is necessary to reduce the film-forming property of the coating layer. When the content of the film-forming binder in the coating layer is reduced, the resultant cast-coated paper sheet exhibits a reduced gloss. Therefore, it is extremely difficult to obtain a cast-coated paper sheet having both a high gloss and a satisfactory applicability to the ink jet recording.

To solve the above-mentioned problem, Japanese Unexamined Patent Publication No. 7-89,220 discloses a cast-coated paper sheet, having both excellent gloss and superior ink absorption, usable for an ink jet recording system. The cast coated paper sheet is produced by undercoating a surface of a paper sheet substrate with a undercoat layer comprising, as principal components, a pigment and a binder, coating the undercoat layer surface with a coating liquid containing, as a principal component, a copolymeric resin produced by polymerizing at least two monomers having an ethylenically unsaturated bond and having a gloss-transition temperature of 40° C. or more, to form a cast-coating liquid layer, pressing the cast-coating liquid layer in wet condition, against a mirror-finished casting drum surface and drying the cast coating liquid layer on the casting drum surface to form a cast-coated layer.

Currently, due to the rapid speed of ink jet printers, the high precision of the printed images and the full colored images, the use of the ink jet printing system is spreading, and thus the ink jet recording sheets are required to have a high gloss and improved qualities of the received ink images, namely a high color density and clarity. For example, high gloss and image quality comparative with those of silver salt type photographic prints are required from the ink jet recording sheets. To meet with the requirements, the gloss and printing performance of the ink jet recording sheets must be further improved.

Japanese Unexamined Patent Publication No. 7-329,412 discloses an ink jet recording sheet in which a cationic compound is contained in a substrate and an ink-receiving layer. In this case, the cationic compound is used for the purpose of preventing migration or permeation of ink in the printed portions of the recording sheets. This publication is quite silent as to the gloss of the ink jet recording sheet.

SUMMARY OF THE INVENTION

An object of the present invention is to provide an ink jet recording sheet having excellent gloss of ink-image-formed portions and non image-formed portions, superior ink absorption and a satisfactory water resistance of images and capable of recording ink images with a high color density and clarity.

The above-mentioned object can be attained by the ink jet recording sheet of the present invention which comprises a substrate sheet;

at least one ink receiving layer formed on at least one surface of the substrate sheet and comprising a pigment and a binder; and at least one gloss layer formed on the ink receiving layer and comprising a polymer resin, at least one cationic compound being impregnated in the substrate sheet or coated on at least one surface of the substrate sheet on which the ink receiving layer is formed.

DESCRIPTION OF THE PREFERRED EMBODIMENTS

The ink jet recording sheet comprises a substrate sheet, at least one ink receiving layer formed on at least one surface of the substrate sheet and at least one gloss layer formed on the ink receiving layer.

There is no limitation to the type and dimensions of the substrate sheet. Usually, the substrate sheet is selected from paper sheets including acid paper sheets and neutralized paper sheets, synthetic paper sheets and air-permeable polymer films. Especially, the paper sheets are preferred for the substrate sheet.

In the ink jet recording sheet of the present invention, a cationic compound is impregnated in the substrate sheet or coated on a surface of the substrate sheet on which surface the ink receiving layer is arranged. The cationic compound usable for the present invention is not limited to a specific class of compounds as long as the compound molecule has a cationic moiety. To cause the cationic compound to be retained in or on the substrate sheet with a high efficiency, however, the cationic compound is preferably selected from cationic oligomers and polymers having a high molecular weight of, for example, 1000 or more. There is no specific upper limit to the molecular weight. To stop the cationic compound-containing coating solution having too high a viscosity, the upper limit of the molecular weight is preferably 1,000,000 or less.

The cationic compounds usable for the present invention include cationic resins (cationic polymeric compounds) and low molecular weight cationic compounds (cationic monomeric compounds), for example, cationic surface active compounds. To retain the cationic compounds on the substrate sheet such as paper sheet with a high efficiency, the cationic compounds are preferably selected from the cationic resins which may be practically used in the form of an aqueous solution or an aqueous emulsion. There is no limitation to the molecular weight of the cationic resins. In view of the ease of handling, coating and impregnating, however, the molecular weight of the cationic resins is preferably about 1000 to about 1,000,000.

Also, the cationic resin may be used in the form of cationic organic pigment particles which have been prepared by insolubilizing the cationic resins by, for example, reacting them with a cross-linking agent into the form of fine particles. The cationic pigment particles can be produced by copolymerizing a cationic comonomer with a polyfunctional comonomer to form a cross-linked polymer particle, or by cross-linking a cationic resin having cross-linking reactive groups, for example, hydroxyl, carboxyl, amino, and/or acetacetyl groups and optionally a cross-linking agent, by means of heating or radiation, to provide a cross-linked resin.

The cationic resins usable for the present invention include:

1) polyalkylenepolyamines, for example, polyethylenepolyamines and polypropylenepolyamines, and derivatives thereof;
2) acrylic resins having at least one member selected from secondary amine groups, tertiary amino groups and quaternary ammonium groups;
3) polyvinylamines and polyvinylamidines;
4) dicyandiamide resins, for example, dicyandiamide-formaldehyde polycondensation products, dicyandiamidediethylenetriamine polycondensation products and polyalkylenepolyaminedicyandiamide copolymers;
5) epichlorohydrin-dimethylamine addition polymerization products;
6) dimethyldiallyl ammonium chloride-$SO_2$ copolymerization products;
7) diallylamine-$SO_2$ copolymerization products;
8) dimethyldiallyl ammonium chloride polymerization products;
9) allylamine salt polymerization products;
10) dialkylaminoethyl(meth)acrylate quaternary salts polymerization products;
11) acrylamide-diallylamine salt copolymerization products; and
12) polyaminoepoxy resins, ring-opening polymerization products of ethyleneimine, homo- and co-polymers of cationic vinyl monomers and chitosan.

Among the above-mentioned cationic compounds, the dicyandiamide resins are preferably used for the present invention, because they exhibit excellent effects desired for the present invention.

Especially, the copolymers of polyalkylenepolyamines with dicyandiamide are preferred. For example, cationic resins consisting of copolymers of at least one member selected from straight chain polyamines, for example, diethylenetriamine, triethylenetetramine, tetraethylenepentamine and iminobispropylamine and organic and inorganic salts, for example, hydrochloric acid salts, sulfates and acetates thereof, with dicyandiamide, are more preferred.

In the application of the cationic compound to the substrate sheet, a solution of the cationic compound in water or alcohols is impregnated in or coated on a surface of the substrate sheet by using a size-press machine, gate roll coater, blade coater, air knife coater, roll coater, bar coater or gravure coater. The impregnation or coating of the cationic compound solution may be affected within a paper-forming system (paper-making machine) or outside of the paper-forming system. When the impregnation or coating is carried out, one or both of the surfaces of the substrate sheet are coated with the cationic compound. Also, the cationic compound is applied to at least one surface of the substrate sheet on which surface the ink receiving layer and then the gloss layer are formed.

Usually, the cationic compound is applied preferably in a dry amount of 0.1 to 10 $g/m^2$, more preferably 0.2 to 5 $g/m^2$ to each of the substrate sheet. If the cationic compound amount is less than 0.1 $g/m^2$, the desired effect may not be obtained. Also, an amount more than 10 $g/m^2$ may cause the desired effect to be saturated and an economical disadvantage may occur. The cationic compound may be applied alone or optionally in a mixture with a binder to the substrate sheet. Optionally, a resin which is usually used as a binder is mixed to the coating liquid or impregnating liquid containing the cationic component. The mixed binder contributes in adjusting the viscosity and coverage of the cationic compound coating liquid and to enhancing the water resistance of the substrate sheet, and surface strength and interlaminar strength of the recording sheet. Also, in the drying step of the size-press procedure the mixed binder enables the cohesion of the recording sheet to the cylinder dryer to be prevented and the resultant recording sheets to exhibit a uniform quality even when the coating amount is fluctuated.

The above-mentioned binder contains at least one member selected from, for example, proteins, for example, casein, soybean protein and synthetic proteins, starch compounds, for example, starch and oxidized starches, polyvinyl alcohols, cellulose compounds, for example, carboxymethylcellulose and methylcellulose, conjugated diene polymer latices, for example, styrene-butadiene copolymer latices and methylmethacrylate-butadiene copolymer latices, acrylic polymer latices, and vinyl polymer latices, for example, ethylene-vinyl acetate copolymer latices, which are usually used as coating agent for paper sheets. These binders can be used alone or in combination of two or more thereof.

When the cationic compound is used together with the binder, there are no limitations to the types and coverages thereof. Usually, the cationic compound and the binder are employed preferably in a mixing ratio in weight of 10/90 to 90/10, more preferably 20/80 to 80/20. Optionally, the cationic compound is employed in combination with a pigment, for example, usable for the ink receiving layer.

When the substrate sheet consists of a paper sheet, degree of sizing of the cationic compound-applied paper sheet is variable depending on the basis weight of the paper sheet and the amount of the applied cationic compound, and is not limited to a specific value. Usually, when the paper sheet for the substrate sheet has a basis weight of 100 g/m$^2$, preferably, the cationic compound-applied substrate paper sheet has a stöckigt sizing degree of 1 to 100 seconds. If the sizing degree is too low, the application of the ink receiving layer may cause the substrate paper sheet to wrinkle. Also, if it is too high, the resultant ink jet recording sheet may exhibit an unsatisfactory ink absorption.

On the cationic compound-applied substrate sheet, an ink receiving layer comprising a pigment and a binder is coated. The ink receiving layer serves as an undercoat layer for the gloss layer.

The pigments usable for the ink receiving layer are selected from inorganic pigments, for example, kaolin, clay, calcined clay, amorphous silica (or non-crystalline silica), zinc oxide, aluminum oxide, aluminum hydroxide, calcium carbonate, satin white, aluminum silicate, alumina, colloidal silica, zeolite, sepiolite, smectite, synthetic smectite, magnesium silicate, magnesium carbonate, magnesium oxide and diatomaceous earth pigments, and organic pigments, for example, styrene polymer, urea resin, and benzoquanamine resin pigments, which are usually used for the production of coated paper sheets. Among the above-mentioned pigments, amorphous silica, aluminum oxide, zeolite and synthetic smectite pigments are specifically preferred because they can cause the resultant ink receiving layer to have a porous structure and exhibit an excellent ink absorption.

In another preferred embodiment of the present invention, the pigment contains amorphous silica and zeolite. When the zeolite is contained, the resultant recording sheet exhibits an enhanced image retention. Also, amorphous silica causes the resultant recording sheet to exhibit an enhanced color density of the images and an increased gloss of the gloss layer.

The zeolite is a general name of crystalline aluminosilicates and represented by the following general formula:

$$(M^{I}, M^{II}_{1/2})_m(Al_mSi_nO_{2(m+n)})\cdot XH_2O$$

wherein n and m respectively represent a numeral of 1 or more, and satisfy the relationship $n \geqq m$, $M^{I}$ represents an alkali metal ion, for example, $Na^+$ and $K^+$, $M^{II}$ represents an alkaline earth metal ion, for example, $Ca^{2+}$, $Mg^{2+}$ and $Ba^{2+}$, and at least one of $M^{I}$ and $M^{II}$ must be present.

The zeolite is preferably selected from synthetic zeolite pigments which preferably have a particle size of 0.5 to 20 $\mu$m.

The synthetic non-crystalline silica pigments are classified, in accordance with the production methods thereof, into wet process products and dry process products. In the wet process, a starting material consisting of sodium silicate is neutralized with an acid to cause fine silica particles to precipitate. The wet process is classified into precipitation method and gelation method. Also, in the dry process, the non-crystalline silica is produced by burning a starting material consisting of silicon tetrachloride with hydrogen and oxygen. The dry process non-crystalline silica pigment is called as white carbon, and known silicic anhydride or hydrated silicic acid. There is no limitation to the average particle size of the synthetic non-crystalline silica particles. Usually, the average particle size is preferably about 0.5 to about 20 $\mu$m. For the purpose of enhancing absorption of the ink, preferably the non-crystalline silica particles have a specific surface area and an oil absorption as high as possible. More preferably, the specific surface area is 100 to 500 m$^2$/g and the oil absorption is 100 to 400 ml/100 g.

The zeolite pigment is preferably used in a content of 3 to 60% by weight based on the total weight of the pigment.

The binder usable for the ink receiving layer preferably contains at least one member selected from, for example, proteins, for example, casein, soybean protein and synthetic proteins, starch compounds, for example, starch and oxidized starches, polyvinyl alcohols, cellulose compounds, for example, carboxymethyl-cellulose and methylcellulose, conjugated diene polymer latices, for example, styrene-butadiene copolymer and methyl methacrylate-butadiene copolymer latices, acrylic polymer latices, vinyl polymer latices, for example, ethylene-vinyl acetate latices, which are usually used for coating paper sheets. These compounds may be used alone or in mixtures of two or more thereof.

The binder for the ink receiving layer is preferably used in an amount of 1 to 40 parts by weight, more preferably 2 to 20 parts by weight, per 100 parts by weight of the pigment. If the amount of the binder is less than 1 part by weight, the resultant ink receiving layer may have an unsatisfactory mechanical strength and may be easily damaged or powdered. Also, if the binder is used in too high an amount, the resultant ink receiving layer may exhibit an insufficient ink absorption and may not exhibit a desired ink jet recording performance.

The ink receiving layer optionally contains at least one cationic compound selected from those the same as those usable for the substrate sheet. The cationic compound contained in the ink receiving layer contributes to enhancing water resistance of the ink images received in the ink receiving layer. There is no limitation to the content of the ink receiving layer. Usually, the cationic compound is contained preferably in an amount of 1 to 30 parts by weight, more preferably 5 to 20 parts by weight, per 100 parts by weight of the pigment, in the ink receiving layer.

Further, the ink receiving layer optionally contains an additive comprising at least one member selected from, for example, dispersing agents, thickening agents, anti-foaming agents, coloring agents, anti-static agents and preservatives. The ink receiving layer is formed by preparing a coating liquid for the ink receiving layer comprising the pigment, the binder and the optional cationic compound and/or other additive, in a total solid content of 5 to 65% by weight, coating a surface of the cationic compound-applied substrate sheet having a basis weight of 20 to 400 g/m$^2$ with the coating liquid by using a conventional coating means, for example, blade coater, air knife coater, roll coater, brush coater, champlex coater, bar coater, gravure coater, die coater and curtain coater, and drying the coating liquid layer to form an ink receiving layer in a dry solid weight of 1 to 50 g/m$^2$, more preferably 2 to 20 g/m$^2$. Thereafter, optionally, the ink receiving layer is subjected to a smoothing treatment, for example, a super calender treatment and/or a brushing treatment.

The ink receiving layer is coated with a gloss layer. The gloss layer comprises a polymer resin and optionally a pigment. The polymer resin preferably consists of a polymerization product of at least one monomer having an ethylenically unsaturated bond. The gloss layer must allow the ink to easily pass therethrough and penetrate into the ink receiving layer. Namely, the gloss layer must be as porous and ink-permeable as possible unless the gloss of the gloss layer becomes unsatisfactory. For this purpose, it is preferable that the drying conditions for the coating liquid layer for the gloss layer are controlled so that the polymer resin incompletely forms a coating film, while creating a desired gloss. Also, when a pigment is contained, the pigment is preferably selected from those having a small particle size, for example, of about 300 nm or less preferably 200 nm or less, so as to not reduce the transparency and the gloss of the gloss layer. Such pigment can include colloidal silica, alumina sol and silica sol. The content of the pigment is adjusted to such an extent that the presence of the pigment does not cause a great reduction in the transparency of the resultant gloss layer. Usually, the pigment is contained preferably in a content of 200 parts by weight or less, more preferably 50 to 150 parts by weight, based on the 100 parts by weight of the polymer resin. If the content of the pigment is too much, the resultant gloss layer may exhibit an insufficient gloss.

The polymer resins for the gloss layer include, for example, polyvinyl alcohol resins, aqueous urethane resins and polymerization products of ethylenically unsaturated monomers.

The aqueous urethane resins can be produced by reacting polyisocyanate compounds, for example, diisocyanate, triisocyanate and tetraisocyanate compounds with polyol compounds.

The polymer resin for the gloss layer is preferably a polymerization product of at least one ethylenically unsaturated monomer. The ethylenicaily unsaturated monomers are preferably selected from acrylic esters having a hydrocarbon group with 1 to 18 carbon atoms, for example, methyl acrylate, ethyl acrylate, butyl acrylate, 2-ethylhexyl acrylate, lauryl acrylate, 2-hydroxyethyl acrylate and glycidyl acrylate; methacrylic esters having a hydrocarbon group with 1 to 18 carbon atoms, for example, methyl methacrylate, ethyl methacrylate, 2-hydroxyethyl methacrylate, 2-hydroxypropyl methacrylate, and glycidyl methacrylate; ethylenically unsaturated aromatic monomers, for example, styrene, α-methylstyrene and vinyl toluene; aliphatic vinyl monomers, for example, acrylonitrile, vinyl chloride, vinylidene chloride, vinyl acetate, vinyl propionate, acrylamide and N-methylolacrylamide, and ethylenically unsaturated hydrocarbon monomers, for example, ethylene and butadiene.

The polymer resin for the gloss layer may comprise one or more selected from homopolymers of the above-mentioned monomers and copolymers of two or more of the above-mentioned monomers, and modification products of the homopolymers and copolymers. The modified polymers include, for example, carboxylated polymers and carboxylated polymers further modified to be alkali-reactive. Also, the modified polymer includes complexes produced by polymerizing the ethylenically unsaturated monomers in the presence of a colloidal silica so as to introduce Si—O—R bonds (wherein R represents a group derived from the monomers) into the resultant polymers, or other complexes produced by introducing a functional group, for example, SIOH group, which is reactive with the colloidal silica, into the above-mentioned polymers or copolymers, and reacting the functional group-introduced polymers or copolymers with the colloidal silica.

The gloss layer is formed by coating a coating liquid containing, as a principal component, the polymer resin on the ink receiving layer, and drying the coating liquid layer.

The gloss layer may be formed by coating a gloss layer-forming coating liquid on a smooth surface of a plastic film, solidifying the coating liquid on the smooth plastic film surface, and transferring the resulting solid layer from the smooth plastic film surface to the ink receiving layer surface, to obtain a gloss surface of the gloss layer. The smooth surface of the plastic film preferably has a surface roughness Ra of 0.5 μm or less, more preferably 0.05 μm or less, determined in accordance with Japanese Industrial Standard (JIS) B0601.

Preferably, the gloss layer is formed by coating the coating liquid containing the polymer resin on the ink receiving layer, pressing the coating liquid layer which is in wet condition, at a temperature of, for example, 50° C. to 150° C., preferably 70° C. to 120° C. against a mirror-finished drum surface, and drying the pressed coating liquid on the mirror-finished drum surface. Alternatively, the gloss layer is formed by coating the polymer resin-containing coating liquid on the ink-receiving layer, drying the coating liquid layer, rewetting the dried layer, and then pressing the rewetted layer against the mirror-finished drum surface and drying the pressed layer under the same conditions as mentioned above. These methods are referred to as a cast-coating method, and contribute to obtaining a gloss layer having excellent gloss, and ink-absorption. Among these methods, preferably the contact of the coating liquid layer with the mirror-finished casting drum surface is carried out while the coating liquid layer is still in a wet condition, namely by a wet cast-coating method.

The polymer resin for the gloss layer preferably has a glass transition temperature of 40° C. or more, more preferably 50 to 100° C. If the glass transition temperature is lower than 40° C., when the coating liquid layer containing polymer resin is dried, the film formation of the polymer resin proceeds excessively, the porosity of the resultant gloss layer may be reduced too much, and thus the ink absorption of the gloss layer may become unsatisfactory.

Also, if the coating liquid layer for the gloss layer is dried at too high a drying temperature, the porosity of the resultant gloss layer may become too low and the ink absorption of the gloss layer may be unsatisfactory. Further, if the drying temperature is too low, the resultant gloss layer may exhibit an insufficient degree of gloss and the process efficiency in the gloss layer formation may be unsatisfactory. Accordingly, the drying procedure of the gloss layer preferably carried out at a temperature of 50 to 150° C., more preferably 70 to 100° C.

The gloss layer optionally contains an additive comprising at least one member selected from, for example, pigments, anti-foaming agents, coloring agents, anti-static agents, preservatives, dispersing agents and thickening agents which are usually used for the coated paper sheets for usual printing and ink jet recording, to adjust the brightness of the gloss layer and the viscosity and fluidity of the coating liquid, as desired.

As mentioned above, the coating liquid is coated on the ink receiving layer by using a conventional coating device, for example, a blade coater, air knife coater, roll coater, brush coater, champlex coater, bar coater or gravure coater, die coater or curtain coater. Preferably, the coating liquid layer is pressed, in wet condition, against a mirror-finished surface of a casting drum at a temperature of 50 to 150° C., and dried so as to transfer the mirror surface to the surface of the gloss layer. The gloss layer is preferably formed in a dry solid amount of 0.2 to 30 g/m$^2$, more preferably 1 to 10 g/m$^2$. If the amount is too small, the resultant gloss layer may exhibit an unsatisfactory gloss. Also, if the amount is too great, the resultant gloss layer may cause an unsatisfactory ink drying rate and a reduced color density of printed ink images. Optionally, the gloss layer may be smoothed by a super calender treatment.

The ink jet recording sheet of the present invention exhibits excellent gloss and superior ink jet recording performance, due to the fact that the cationic compound is applied to the substrate sheet. The mechanism of enhancing the gloss and ink jet recording performance by the cationic compound applied to the substrate sheet is not completely clear. It is assumed, however, that when a coating liquid for the ink receiving layer is coated on a surface of a substrate sheet impregnated or coated with a cationic compound, the coagulation of the coating liquid is promoted by the cationic compound so that an excessive penetration of the coating liquid into the substrate sheet is prevented, and thus an ink receiving layer with an appropriate porosity is formed. Then, when a coating liquid for the gloss layer is coated on the ink receiving layer, penetration of the coating liquid into the ink receiving layer and then into the substrate sheet is restricted for the same reasons as mentioned above, and therefore a gloss layer having a high and uniform gloss is formed. The inventors of the present invention have confirmed that when the cationic compound was omitted from the ink jet recording sheet of the present invention, or replaced by a non-cationic substance, for example, binder, the specific effects of the present invention could not be obtained.

In the ink jet recording sheet of the present invention, the above-mentioned specific effects of the present invention can be further enhanced by adding a cationic compound to the ink receiving layer.

The ink jet recording sheet of the present invention has a gloss layer with excellent gloss and an ink receiving layer which is porous and thus exhibits a high ink absorption, and a high resistance to surface-roughening due to swelling of portions of the ink receiving layer by the received ink. Therefore, as a whole, the ink jet recording sheet can maintain the high gloss of the gloss layer surface even after printing.

The ink jet recording sheet of the present invention enables the recorded ink images to exhibit a high and uniform color density and a high water resistance.

EXAMPLES

The present invention will be further explained by the following examples.

In the Examples, the following tests were carried out.

(1) Ink Jet Recording Performance

A specimen of an ink jet recording sheet was subjected to an ink jet printing procedure by using an ink jet printer (trademark: BJC 600J, made by Canon Corp.)

(A) Uniformity of Printed ink Images

On portions of the specimen, the cyan and magenta-colored inks were successively solid-printed. In each of the printed portions, uniformity in color density was evaluated by naked eye observation as follows.

| Class | Uniformity |
|---|---|
| 3 | Quite uniform |
| 2 | Slightly uneven |
| 1 | Uneven |

(B) Ink-drying Rate

Immediately after the successive printing with the cyan and magenta-color inks, the ink images were rubbed with fingers, and the ink-drying rate was evaluated as follows.

| Class | Ink-drying rate |
|---|---|
| 3 | No soil was found on fingers |
| 2 | Slight soil was found on fingers |
| 1 | Soil on fingers was clear |

(C) Color Density

The color density of the solid printed black ink images was measured by Macbeth reflection color density tester (Model RD-914).

(2) Glosses of Non-printed Portion and Printed Portion

The glosses of non-printed portion and black-ink printed portion of the specimen at an angle of 75 degrees from the surface of the specimen were measured in accordance with Japanese Industrial Standard (JIS) P 8142.

(3) Water Resistance

Five water drops from a dropping pipette were placed on the solid-printed portion of the specimen and dried at room temperature. The tested portion was observed by naked eye and evaluated as follows.

| Class | Spread of ink |
|---|---|
| 4 | No ink spread was found. |
| 3 | Very slight ink spread was found. |
| 2 | Slight ink spread was found. |
| 1 | Significant ink spread was found. |

Example 1

A paper sheet having a basis weight of 100 g/m$^2$ was coated on both the front and back surfaces thereof with 40 ml/m$^2$ of an aqueous solution containing 5% by weight of a cationic dicyandiamide copolymer (copolymer of a polyalkylenepolyamine with dicyandiamide, trademark: Neofix E-117, made by Nikka Kagakukogyo K.K.) by using a size-press apparatus arranged in a paper-forming machine, and dried. The dry solid amount of the cationic compound attached to each surface of the paper sheet was 1 g/m$^2$.

Separately, an aqueous coating liquid for an ink receiving layer was prepared in the following composition.

| Component | Parts by weight |
|---|---|
| Pigment | |
| Amorphous silica (*)[1] | 50 |
| Zeolite (*)[2] | 50 |
| Binder | |
| Polyvinyl alcohol (*)[3] | 10 |
| Cationic resin | |
| Dicyandiamide polymer (*)[4] | 10 |
| Dispersing agent | |
| Sodium polyphosphate | 0.5 |
| Total dry solid content: 18% by weight | |

Note:
(*)[1]Trademark: Finesel X-37, made by K.K. Tokuyama, average particle size: 3 μm, primary particle size: 10 nm, specific surface area: 240 to 280 m$^2$/g
(*)[2]Trademark: Toyobuilder, made by Toso K.K., $Na_2.Al_2O_3.2SiO_2.4.5H_2O$, average particle size: 1.5 μm, oil absorption: 35 to 40 ml/100 g, A type synthetic zeolite
(*)[3]Trademark: PVA 117, made by Kuraray K.K.
(*)[4]Trademark: Neofix E-117, made by Nikka Kagakukogyo K.K.

The aqueous coating liquid was coated on the front surface of the cationic resin-applied paper sheet by an air knife coater, and dried, to form an ink receiving layer with a dry solid weight of 8 g/m$^2$.

Separately, an aqueous coating liquid for a gloss layer was prepared in the following composition.

| Component | Part by weight |
|---|---|
| Polymer resin | |
| Styrene-2-methylhexyl acrylate copolymer/colloidal silica complex (*)[5] | 100 |
| Thickening and dispersing agent | |
| Alkyl vinylether-maleic acid derivative copolymer | 5 |
| Releasing agent | |
| Lecithin | 3 |
| Total dry solid content: 25% by weight | |

Note:
(*)[5]Weight ratio of copolymer to colloidal silica: 50/50. Glass transition temperature: 75° C.

The aqueous coating liquid for the gloss layer was coated on the ink receiving layer by a roll coater, the resultant coating liquid layer was pressed against a mirror-finished surface of a casting drum at a temperature of 85° C. and dried at the temperature. The resultant recording sheet was separated from the casting drum surface.

An ink jet recording sheet having a gloss layer. The gloss layer had a dry solid weight of 8 g/m$^2$.

The test results of the ink jet recording sheet are shown in Table 1.

Example 2

An ink jet recording sheet was produced by the same procedures as in Example 1, except that a front surface of a substrate sheet consisting of a paper sheet with a basis weight of 100 g/m$^2$ was coated with an aqueous solution of 5% by weight of a cationic dicyandiamide polymer (Neofix E-117, Nikka Kagakukogyo K.K.), in a dry weight of 1 g/m$^2$, by using a bar coater, and dried.

The test results are shown in Table 1.

Example 3

An ink jet recording sheet was produced by the same procedures as in Example 1, except that a front surface of a substrate sheet consisting of a paper sheet with a basis weight of 100 g/m$^2$ was coated with an aqueous solution of 5% by weight of a cationic acrylamide polymer (trademark: Sumiresresin SR 1001, made of Sumitomo Kagakukogyo K.K.), in a dry weight of 1 g/m$^2$, by using a bar coater, and dried.

The test results are shown in Table 1.

Example 4

An ink jet recording sheet was produced by the same procedures as in Example 1, except that the aqueous coating liquid for the ink receiving layer of Example 1 was replaced by an aqueous coating liquid having the following composition and a dry solid content of 18% by weight.

| Component | Part by weight |
|---|---|
| Pigment | |
| Aluminum oxide with an average particle size of 2.5 μm | 100 |

-continued

| Component | Part by weight |
|---|---|
| Binder | |
| Polyvinyl alcohol (PVA 117, Kuraray) | 10 |
| Cationic polymer | |
| Dicyandiamide polymer (Neofix E-117, Nikka Kagakukogyo K.K.) | 10 |
| Dispersing agent | |
| Sodium polyphosphate | 0.5 |

The test results are shown in Table 1.

Example 5

An ink jet recording sheet was produced by the same procedures as in Example 1, except that both the front and back surfaces of a substrate sheet consisting of a paper sheet with a basis weight of 100 g/m$^2$ was coated with 40 ml/m$^2$ of an aqueous solution of 5% by weight of a cationic dicyandiamide polymer (Neofix E-117, Nikka Kagakukogyo K.K.), and 2% by weight of a modified starch (trademark: Ace A, made by Oji Corn Starch K.K.) in a total dry weight of 1.4 g/m$^2$ on each surface, by using a size-press apparatus arranged in the paper-forming machine, and dried.

The test results are shown in Table 1.

Example 6

A paper sheet having a basis weight of 127 g/m$^2$ was coated on both the front and back surfaces thereof with 40 ml/m$^2$ of an aqueous solution containing 5% by weight of the same cationic dicyandiamide copolymer (trademark: Neofix E-117, made by Nikka Kagakukogyo K.K.) as in Example 1 by using a size-press arranged in a paper-forming machine, and dried. The dry solid amount of the cationic compound attached to each surface of the paper sheet was 1 g/m$^2$.

Separately, an aqueous coating liquid for an ink receiving layer was prepared in the following composition.

| Component | Parts by weight |
|---|---|
| Pigment | |
| Amorphous silica (*)[5] | 100 |
| Binder | |
| Silyl-modified polyvinyl alcohol (*)[6] | 25 |
| Cationic resin | |
| Dicyandiamide copolymer (*)[4] | 5 |
| Diallyldimethyl ammonium salt resin (*)[7] | 15 |
| Blueing agent (*)[8] | 0.1 |
| Brightening agent (*)[9] | 2 |
| Dispersing agent | |
| Sodium pyrdphosphate | 0.5 |
| Total dry solid content: 18% by weight | |

Note:
(*)[5]Trademark: Finesil X-45, made by K.K. Tokuyama
(*)[6]Trademark: R-1130 made by Kuraray K.K., Specific surface area: 290 m$^2$/g
(*)[7]Trademark: Unisense CP 103, made by Senka K.K.
(*)[8]Trademark: DC Blue XB, made by Dainihon Seikakogyo K.K.
(*)[9]Trademark: Whitex BPSH, made by Sumitomo Kagakukogyo K.K.

The aqueous coating liquid was coated on the front surface of the cationic resin-applied paper sheet by an air knife coater, and dried, to form an ink receiving layer with a dry solid weight of 6 g/m$^2$.

Separately, an aqueous coating liquid for a gloss layer was prepared in the following composition.

| Component | Part by weight |
|---|---|
| Polymer resin | |
| Styrene-2-methylhexyl acrylate copolymer/colloidal silica complex (*)[10] | 100 |
| Thickening and dispersing agent | |
| Alkyl vinylether-maleic acid derivative copolymer | 1.5 |
| Releasing agent | |
| Lecithin | 1.5 |
| Total dry solid content: 25% by weight | |

Note:
(*)[10]Weight ratio of copolymer to colloidal silica: 40/60.

The aqueous coating liquid for the gloss layer was coated on the ink receiving layer by a roll coater, the resultant coating liquid layer was pressed against a mirror-finished surface of a casting drum at a temperature of 85° C. and dried at the temperature. The resultant recording sheet was separated from the casting drum surface.

An ink jet recording sheet having a gloss layer. The gloss layer had a dry solid weight of 6 g/m$^2$.

The test results of the ink jet recording sheet are shown in Table 1.

Comparative Example 1

An ink jet recording sheet was produced by the same procedures as in Example 1, except that no cationic polymer was applied to the substrate paper sheet.

The test results are shown in Table 1.

Comparative Example 2

An ink jet recording sheet was produced by the same procedures as in Example 4, except that no cationic polymer was applied to the substrate paper sheet.

The test results are shown in Table 1.

Comparative Example 3

An ink jet recording sheet was produced by the same procedures as in Example 1, except that both the front and back surfaces of a substrate sheet consisting of a paper sheet with a basis weight of 100 g/m$^2$ was coated with 40 ml/m$^2$ of an aqueous solution of 5% by weight of a modified starch (Ace A, Oji Corn Starch), in a dry weight of 1 g/m$^2$ on each surface, by using a size-press apparatus arranged in the paper-forming machine, and dried.

The test results are shown in Table 1.

Comparative Example 4

An ink jet recording sheet was produced by the same procedures as in Example 1, except that no gloss layer was formed.

The test results are shown in Table 1.

Comparative Example 5

A high gloss ink jet recording sheet available under a trademark of HG 101, from Canon K.K. was subjected to the above-mentioned tests.

The test results are shown in Table 1.

TABLE 1

| | | Item | | | | | |
|---|---|---|---|---|---|---|---|
| | | Ink jet recording performance | | | | | |
| | | Uniformity | Ink | Color | Gloss (%) | | |
| Example No. | | in solid print | drying rate | density of images | Non-printed portion | Ink-printed portion | Water resistance |
| Example | 1 | 3 | 3 | 1.80 | 90 | 85 | 3 |
| | 2 | 3 | 3 | 1.80 | 90 | 85 | 3 |
| | 3 | 3 | 3 | 1.90 | 80 | 75 | 4 |
| | 4 | 3 | 3 | 1.75 | 92 | 87 | 3 |
| | 5 | 3 | 3 | 1.80 | 90 | 85 | 3 |
| | 6 | 3 | 3 | 2.00 | 90 | 85 | 4 |
| Comparative Example | 1 | 3 | 3 | 1.65 | 70 | 50 | 2 |
| | 2 | 3 | 3 | 1.65 | 80 | 60 | 2 |
| | 3 | 3 | 3 | 1.65 | 70 | 50 | 2 |
| | 4 | 3 | 3 | 1.75 | 5 | 8 | 3 |
| | 5 | 2 | 1 | 2.30 | 80 | 75 | 1 |

What we claim is:

1. An ink jet recording sheet comprising:

a substrate sheet;

at least one dicyandiamide coated in an amount of 0.1 to 10 g/m$^2$ on at least one surface of the substrate sheet;

at least one ink-receiving layer formed on said coated surface of the substrate sheet and comprising a binder, a cationic compound and a pigment comprising at least one member selected from non-crystalline silica, aluminum oxide, zeolites and synthetic smectites; and at least one gloss layer formed on the ink-receiving layer and comprising a complex of a polymer resin consisting of a polymerization product of at least one ethylenically unsaturated monomer and having a glass transition temperature of 40° C. or more, with colloidal silica.

2. The ink jet recording sheet as claimed in claim 1, wherein the gloss layer is one formed by coating a coating liquid containing the polymer resin on the surface of the ink-receiving layer, pressing the resultant coating liquid layer in wet condition against a mirror-finished drum surface, and drying the pressed coating liquid layer on the mirror-finished drum surface.

3. The ink jet recording sheet as claimed in claim 1, wherein the gloss layer is one formed by coating a coating liquid containing the polymer resin on the surface of the ink-receiving layer; drying the coating liquid layer; rewetting the dried layer; pressing the rewetted layer against a mirror-finished drum surface, and drying the pressed layer on the mirror-finished drum surface.

4. The ink jet recording sheet as claimed in claim 1, wherein the gloss layer further comprises at least one member selected from colloidal silica, alumina sol, and silica sol.

5. The ink jet recording sheet as claimed in claim 1, wherein the pigment for the ink receiving layer comprises non-crystalline silica and a zeolite.

6. The ink jet recording sheet as claimed in claim 5, wherein the zeolite is present in an amount of 3 to 60% by weight based on the total weight of the pigment.

* * * * *